United States Patent [19]

Kobayashi

[11] 4,030,865

[45] June 21, 1977

[54] APPARATUS FOR SIMULTANEOUS DEFIBERIZATION OF WASTE PAPER STOCK AND UNIFORM DISPERSION AND ACCUMULATION OF THE DEFIBERIZED FINE FIBER STOCK FOR DRY WEB FORMATION

[76] Inventor: Tadashi Kobayashi, 1560-2 Tenma, Fuji, Shizuoka, Japan

[22] Filed: July 3, 1975

[21] Appl. No.: 592,910

[30] Foreign Application Priority Data

July 8, 1974 Japan ..... 49-77413

[52] U.S. Cl. ..... 425/82; 241/54; 241/73; 425/83; 425/296; 425/297

[51] Int. Cl.[2] ..... B29C 13/00; B29D 7/00

[58] Field of Search ..... 241/73, 47, 54, 56; 425/83, 82, 115, 296, 297

[56] References Cited

UNITED STATES PATENTS

| | | | |
|---|---|---|---|
| 153,172 | 7/1874 | Kirk et al. | 241/54 |
| 2,735,807 | 2/1956 | Banker | 241/54 X |
| 3,271,215 | 9/1966 | Hoffman | 425/83 X |
| 3,276,928 | 10/1966 | Pearson et al. | 425/83 X |
| 3,549,093 | 12/1970 | Pallmann | 241/73 X |
| 3,630,458 | 12/1971 | Smiley | 241/73 X |

*Primary Examiner*—Robert L. Spicer, Jr.
*Attorney, Agent, or Firm*—George B. Oujevolk

[57] ABSTRACT

An apparatus for simultaneous defiberization of waste paper stock and uniform dispersion and accumulation of the defiberized fine fiber stock for dry web formation comprising a defiberizing drum having cylindrical teeth formed of its inside circumferential plane and an outlet part for the delivery of said defiberized fine stock formed of its lower part, a hollow rotary shaft provided rotatably in said defiberizing drum, a multitude of swing hammers provided swingably around said hollow rotary shaft both circumferentially and axially at respectively regular intervals, said swing hammers having edges formed of their top and facing said cylindrical teeth with a suitable clearance maintained between said edges and cylindrical teeth, air vents provided to the hollow rotary shaft for passing outer air from said shaft to the inside of said drum and a suction wire part for receiving and supporting the thin paper sheet to accumulate the fine stock thereon, said suction wire part being provided under said outlet part having holes opening above the thin paper sheet.

1 Claim, 5 Drawing Figures

APPARATUS FOR SIMULTANEOUS DEFIBERIZATION OF WASTE PAPER STOCK AND UNIFORM DISPERSION AND ACCUMULATION OF THE DEFIBERIZED FINE FIBER STOCK FOR DRY WEB FORMATION

This invention relates to an apparatus for simultaneous defiberization of waste paper stock and uniform dispersion and accumulation of the defiberized fine fiber stock for dry web formation.

Various conventional methods of, and various conventional types of apparatuses for, forming dry web by spreading and stratifying paper stock, prepared by disintegrating waste paper like ordinary board and corrugated board, over a sheet of thin paper and pressing it into the form of web are known. The conventionally-used paper stock prepared from finely disintegrated waste paper, however, is uneven in the thickness and length of fibers and contains fine particles of fibers. Therefore, the paper stock which lacks the general uniformity of fiber size naturally does not permit the formation of homogeneous dry web. Not only that, conventional methods require the installation of defiberizing and dispersing equipment ahead of the web forming-part of paper machine, as it is necessary to defiberize the shives made during the process of introducing the disintegrated stock into the web-forming part by carrying it with air current from a remote place. Another disadvantage of conventional methods is the tendency to forming web of uneven thickness, characterized by thinning toward the middle and thickening toward the sides, as the web is formed by blowing the stock fibers under an air pressure higher than the atmospheric pressure so as to spread them over a thin paper sheet. Still another disadvantage of conventional methods is the necessity of installing a disintegrator for crushing waste paper into fine pieces as stated above separately from the web-forming part and introducing the stock produced by this disintegrator into the web-forming part. The plant as a whole, therefore, becomes so large that it requires not only a high equipment manufacturing cost and a large installation space but also great amounts of operation and maintenance costs.

The present invention aims at removing these disadvantages of conventional dry web manufacturing methods and apparatuses. One of the main advantages of this invention is to prepare stock free from the disadvantage of the stock prepared by conventional methods and highly useful for the formation of uniform dry web by feeding waste paper stock, crushed roughly in advance by apparatus different from the apparatus of this invention, in the space between a multitude of swing hammers of a fixed width provided both circumferentially and axially respectively at regular intervals around a hollow rotary shaft and saw-toothed defiberizing edges provided in stationary state around the edges and defiberizing the stock into fibers of nearly uniform thickness and length by the crushing of the rotating swing hammers and the defiberizing edges. Another advantage of this invention is to totally eliminate the occurrence of shives and consequently the necessity of using any defiberizing and diffusing equipment by letting the defiberized stock drop into the web-forming part with air current caused by the rotation of the swing hammers. It is another advantage of this invention to substantially diminish the size of the plant as a whole for markedly reducing the equipment manufacturing cost, installation space and operation and maintenance costs, for the stock-defiberizing part and web-forming part of this apparatus are integrated into one unit. A further advantage of this invention is to permit the formation of web of nearly uniform thickness which has been difficult to obtain by conventional methods because, according to the method of this invention, the stock is fed to the web-forming part by being conveyed with air current as soon as the stock is defiberized into fibers of prescribed size in the stock-defiberizing part, as stated above, without requiring air pressure different from the atmospheric pressure.

These and other advantages and objects of the present invention and how they are accomplished will become apparent with reference to the accompanying disclosure and drawings wherein.

Figure 1:
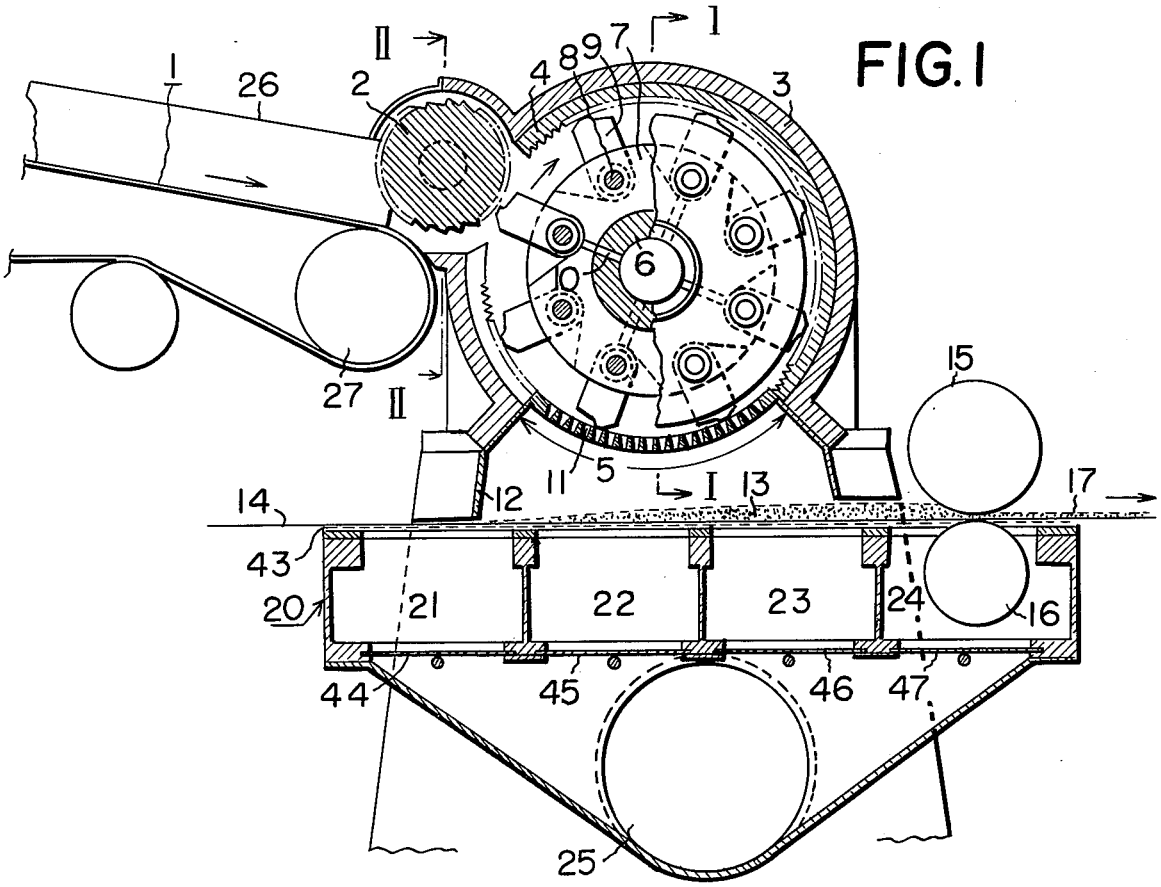
FIG. 1 is a longitudinal section view showing an embodiment of the invention.
Figure 2:
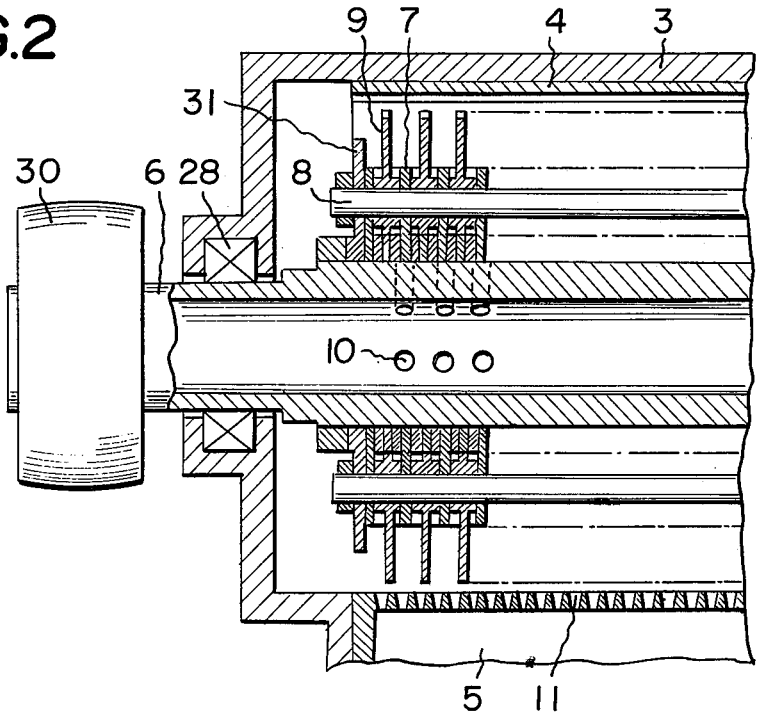
FIG. 2 is a sectional view taken on line I—I in FIG. 1 and showing part of the embodiment as viewed from the left side.
Figure 3:
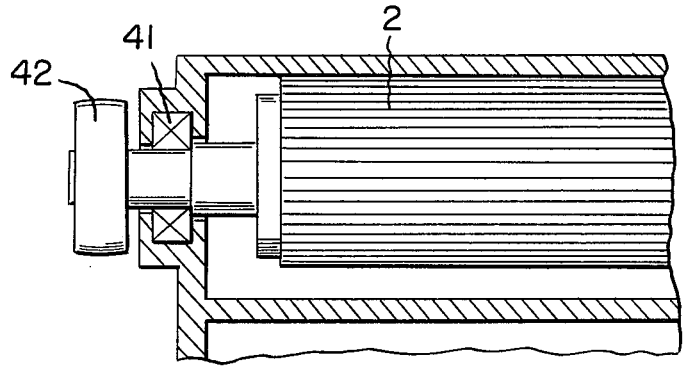
FIG. 3 is a sectional view taken on line II—II in FIG. 1 and showing part of the embodiment as viewed from the left side.
Figure 4:
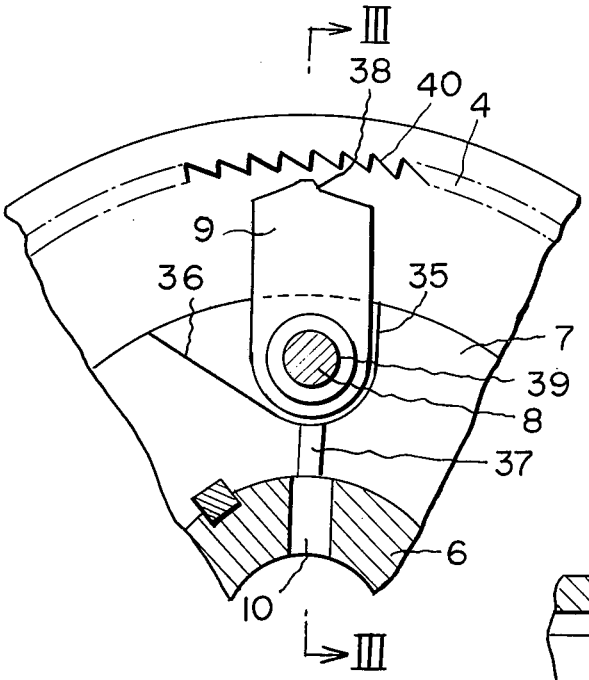
FIG. 4 is an enlarged longitudinal section of part of the embodiment.
Figure 5:
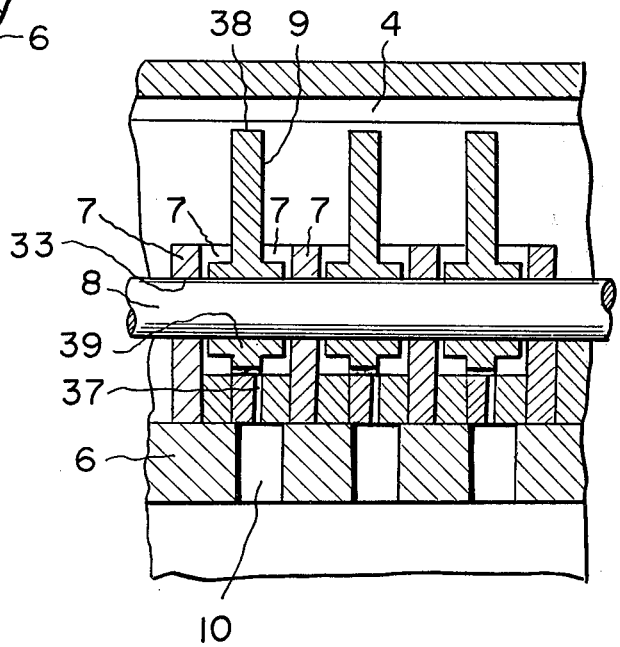
FIG. 5 is a sectional view taken on line III—III in FIG. 3.

The embodiment of the invention shown in the accompanying drawings will be described in detail hereunder by referring to said drawings. Belt 1 for feeding the waste paper stock prepared by roughly crushing waste paper is applied endlessly over return roll 27 and the driving roll (not shown) on the other side. Belt 1 is provided on both sides with frames 26, 26 which are placed apart with a distance corresponding to the width of stock. Above return roll 27 is provided gear 2 for feeding the stock, said gear 2 being supported rotatably on bearings 41, 41 on both sides. This feed gear 2 is saw-toothed and mounted with its end partly entering defiberizing drum 3. An end of the shaft of feed gear 2 is provided with driving wheel 42 which is rotated by external power.

The lower part of defiberizing drum 3 forms outlet part 5 for the delivery of fibrous stock. This outlet part 5 has a multitude of drop holes 11, through which the defiberized fibrous stock drops into outside web-forming chamber 12.

Cylindrical teeth 4 are shaped like saw teeth and provided on all the inside circumferential surface of defiberizing drum 3 except said outlet part 5.

Hollow rotary shaft 6 is provided at the center of defiberizing drum 3 and supported rotatably on bearings 28, 28 on both sides. Said hollow rotary shaft 6 is rotated by external power through driving wheel 30 provided at one end thereof.

Around hollow rotary shaft 6 are provided axially a multitude of supporting plates 7 of regular thickness which are arranged side by side immovably. Supporting plates 7 have supporting members 31, 31 on both sides, and supporting rod 8 is passed through holes 33 drilled through all said supporting plates 7 so that the multitude of said juxtaposed supporting plates 7 are supported firmly by both said supporting rod 8 and said supporting member 31, 31.

Supporting plates 7 have a plurality of notched parts 35 at regular intervals around their periphery. These notched parts 35 are arcs with their centers common with the center of supporting rod 8 and forming inclined parts 36 on one side. Each supporting plate 7 is provided with a groove 37 for passing air and hollow rotary shaft 6 has a multitude of air vents 10 so that the air passage grooves 37 intercommunicate with the air vents 10.

Swing hammers 9 are made of plates of prescribed thickness, and their top is high nearly at the middle to form cutting edge 38 and their bottom is semicircular and provided with supporting hole 39 at its center.

Swing hammers 9 have their bottom fitted to the notched parts 35 of the supporting plates 7, and they are supported by supporting rod 8 inserted into supporting hole 39 and also by supporting plates 7, 7 placed on both sides. Swing hammers 9 are fixed to supporting plates 7 with their edges 38 facing the direction contrary to inclined parts 36, rotary shaft 6 is installed in defiberizing drum 3 with edges 38 of swing hammers 9 facing the direction of rotation and said edges 38 are arranged facing inclined planes 40 of cylindrical teeth 4.

Web-forming chamber 12 covers outlet part 5 of defiberizing drum 3, and the lower part of said chamber 12 is opening immediately above suction wire plane 43.

Thin paper sheet 14 runs continuously on said suction wire plane 43 so that sheet 14 is laid always in the direction of the traveling of web formed, and the fiberous stock defiberized in defiberizing drum 3 is accumulated on sheet 14. Outside web-forming chamber 12 on the delivery side of the web formed are provided top roll 15 and bottom roll 16 respectively facing the upper side and lower side of the web formed so that the layer 13 of fibrous stock accumulated in web-forming chamber 12 is pressed by rolls 15, 16 to be formed into dry web.

Under suction wire plane 43 are provided a plurality of suction boxes 20 having openings, said suction boxes being arranged beneath web-forming chamber 12 extending beyond it in front and behind. In the illustrated embodiment, four suction boxes 21, 22, 23 and 24 are provided. They communicate to one suction pipe 25 through adjusting plates 44 to 47 respectively provided below said suction boxes 21 to 24.

According to the method of this invention, waste paper stock, which is prepared in advance by relatively roughly crushing ordinary board and corrugated board by using a separately installed crushing device, is fed by feed belt 1 into defiberizing drum 3 by the rotation of feed gear 2. Hollow rotary shaft 6 rotates counterclockwise as viewed in FIG. 1. Swing hammers 9, supported by supporting rod 8, are rotated by being swung by the rotation and centrifugal force of hollow rotary shaft 6 and defiberize said preliminarily roughly-crushed waste paper stock into fibrous stock consisting of fibers of nearly uniform thickness and length by the hammer mill action alone of edges 38 at their top and cylindrical teeth 4.

In the embodiment, fibers each having a thickness of 0.27mm and a length of 1.4mm were obtained by selecting the thickness of juxtaposed swing hammers 9 as 8mm, the gap between said swing hammers 9 as 8mm and the clearance between the tip of edges 38 and the tip of cylindrical teeth 4 as 3mm.

As stated above, swing hammers 9 rotate as hollow rotary shaft 6 rotates. The air current produced in defiberizing drum 3 by the rotation of swing hammers 9 flows out through drop holes 11 of outlet part 5. The outer air, therefore, flows continuously from the hollow part of hollow cylindrical shaft 6, through air vents 10 and air passage grooves 37, into defiberizing drum 3. The defiberized fibrous stock is blown by this air current and drops through drop holes 11 into web-forming chamber 12. The stock is then accumulated on thin paper sheet 14 running continuously on suction wire plane 43 as it is fed. Layer 13 of the accumulated stock is pressed between top and bottom rolls 15, 16 with the advance of thin paper sheet 14 and formed into dry web 17 of prescribed thickness.

According to the present invention, the uniform formation of dry web is ensured because the waste paper stock is defiberized into fibrous stock consisting of fibers of nearly uniform thickness and length by the hammer mill action of the cylindrical teeth of the defiberizing drum and the cutting edges of swing hammers and such defiberized stock is used for forming dry web.

Since the defiberized fibrous stock is blown by air current and dropped directly from the inside of defiberizing drum into the web-forming chamber, there is no chance of fiber making shives during the process. Consequently, the use of defiberizing and dispersing equipment required by conventional methods is totally eliminated. Further, the integration of stock-defiberizing part and web-forming part into one unit results in substantial reductions in equipment size and cost, installation area and operation and maintenance costs. Furthermore, this invention realizes the accumulation of defiberized stock without irregularity of thickness at the middle and toward the sides because the stock is accumulated on the thin paper sheet with the web-forming chamber maintained at atmospheric pressure.

Although the most preferable embodiment of this invention is described above by referring to the drawings, it should be understood that various changes and modifications may be made in the design of the apparatus without departing from the scope and spirit of this invention.

I claim:

1. An apparatus for simultaneous defiberization of waste paper stock and uniform dispersion and accumulation of the defiberized fine fiber stock for dry web formation comprising in combination:

a. a defiberizing drum (3) having an opening therein, conveyoring means for radially delivering thereinto roughly crushed waste paper stock, having a return roll (27) outside said drum at said opening, and a feed belt (1) guided by said return roll (27) to guide the paper stock to said drum, a saw-tooth feed gear (2) in said opening above said return roll (27) for feeding the paper stock, into said drum, inner cylindrical teeth (4) disposed inside the drum circumference with a lower outlet section (5) having drop apertures (11) therein for the delivery of said defiberized fine stock formed through said section (5);

b. a hollow rotary shaft (6) rotatably disposed in said defiberizing drum;

c. a multitude of swing hammers (9) affixed swingably around said hollow rotary shaft (6) both circumferentially and axially at respectively regular intervals, said swing hammers (9) having milling edges (38) formed at the top facing said teeth (4) with a suitable clearance maintained between said edges (38) and said teeth (4);

d. air vents (10) on the hollow rotary shaft for passing outer air through said shaft to the inside of said drum; and, e. a suction wire sheet (43) for receiving and supporting a thin paper sheet to receive and accumulate fine stock thereon, said suction wire sheet (43) being disposed under said drop apertures (11).

* * * * *